United States Patent [19]

Bludworth

[11] 4,148,270

[45] Apr. 10, 1979

[54] COUPLING APPARATUS FOR ARTICULATED BODIES

[76] Inventor: Robert A. Bludworth, P.O. Box 12424, Houston, Tex. 77017

[21] Appl. No.: 465,147

[22] Filed: Apr. 29, 1974

[51] Int. Cl.[2] ..... B63B 21/62

[52] U.S. Cl. ..... 114/248

[58] Field of Search ..... 114/235 R, 235 A, 77 R, 114/220, 242, 248, 249; 269/25; 403/83, 84, 87, 110, 121; 180/14 C; 188/251 R

[56] References Cited

U.S. PATENT DOCUMENTS

| | | | |
|---|---|---|---|
| 79,235 | 6/1868 | Lake | 114/220 |
| 1,347,389 | 7/1920 | Larsen | 114/220 |
| 2,567,039 | 9/1951 | Stone | 269/25 |
| 2,877,911 | 3/1959 | Arnot | 180/14 C |
| 2,940,556 | 6/1960 | Jensen et al. | 188/251 R |
| 3,362,372 | 1/1968 | Peterson | 114/235 R |
| 3,512,495 | 5/1970 | Fletcher | 114/235 R |
| 3,525,543 | 8/1970 | Oppenheimer | 403/84 |
| 3,605,675 | 9/1971 | Clemence | 114/235 R |
| 3,815,539 | 6/1974 | Stevens | 114/235 R |
| 3,820,258 | 6/1974 | Fahrner | 114/235 R |
| 3,844,245 | 10/1974 | Yamaguchi | 114/248 |

*Primary Examiner*—Charles E. Frankfort
*Attorney, Agent, or Firm*—Browning, Bushman & Zamecki

[57] ABSTRACT

A coupling apparatus for releasably joining two relatively movable bodies, such as floatable vessels, in which a first coupling assembly having a bearing member with opposed bearing surfaces is secured to one of the vessels and a second coupling assembly, secured to the other of the vessels, has gripping members for frictionally engaging the opposed bearing surfaces. Force modules such as hydraulic rams are provided to effect engagement and disengagement of the gripping members with the bearing surfaces. The apparatus can be used in an articulated marine transportation combination in which the vessels are rigidly coupled or flexibly coupled, the latter allowing certain relative movements of the two vessels.

43 Claims, 14 Drawing Figures fig.14
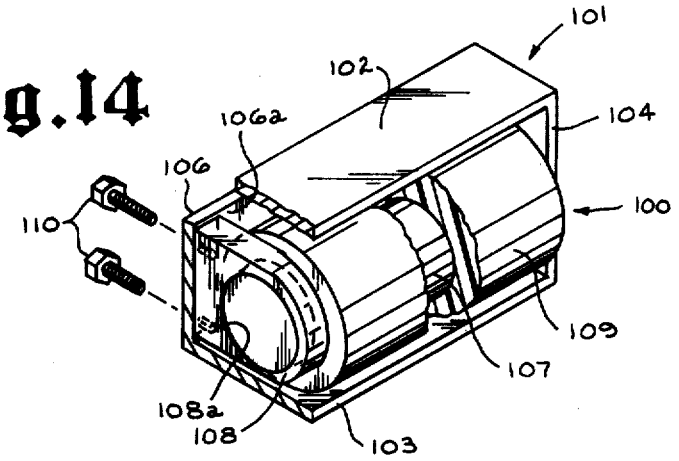
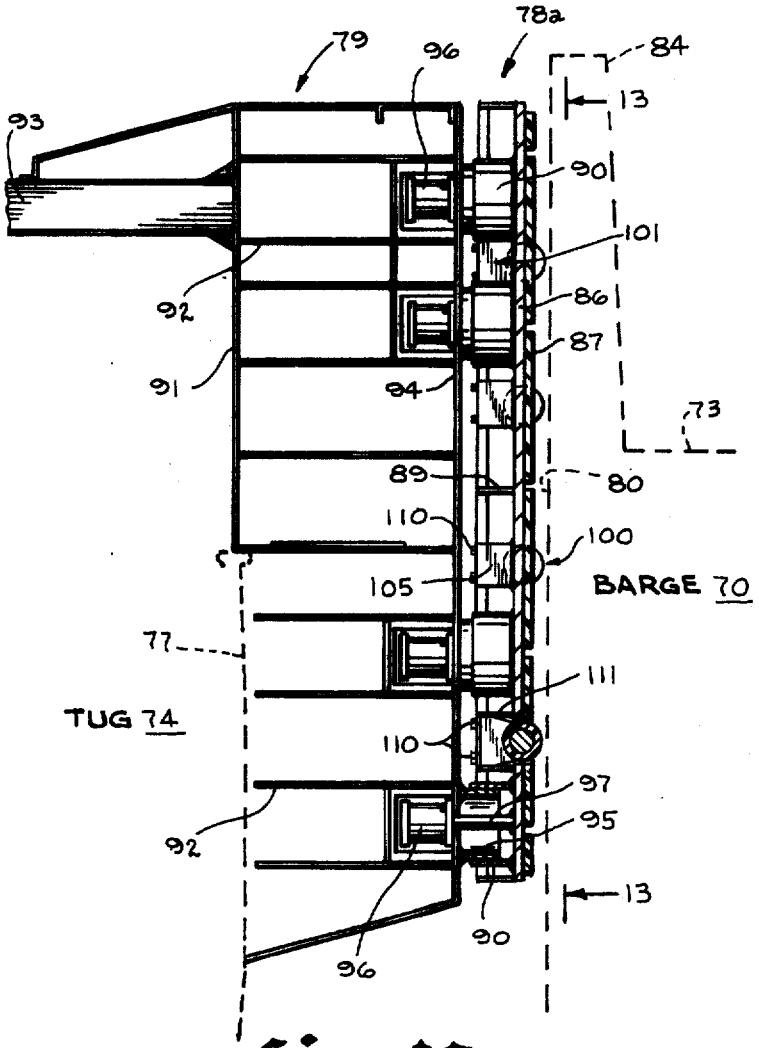
fig.12
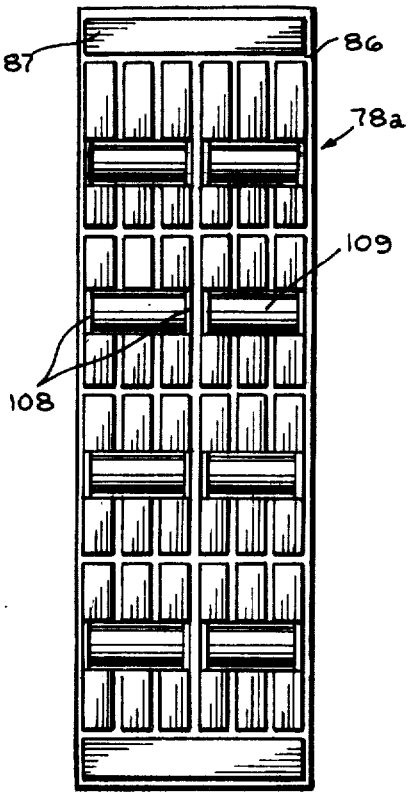
fig.13

COUPLING APPARATUS FOR ARTICULATED BODIES

BACKGROUND OF THE INVENTION

The present invention pertains to an apparatus for releasably coupling two movable bodies, and, more particularly, to an articulated ship employing a coupling arrangement permitting both rigid and flexible interconnection.

The use of tug-barge combinations for transporting cargoes by water offers many advantages over the use of self-propelled vessels such as tankers and the like. While the tug-barge combination can be used quite successfully in calm or sheltered water, the push-towing technique is generally unsuitable for open water travel because of the severity of conditions frequently encountered. In an attempt to reap the economic advantages afforded by tug-barge arrangement and yet overcome the adverse conditions encountered in open water travel, numerous articulated ships have been proposed. These articulated ships have taken numerous forms including both rigidly coupled systems and systems employing flexible coupling, i.e. systems allowing certain substantial relative movements of the coupled vessels. Examples of rigidly coupled vessels are disclosed in such patents as U.S. Pat. Nos. 3,610,196 to Lowry, 3,735,722 to Hooper et al. and 3,486,476 to Breit, Jr. U.S. Pat. Nos. 3,756,183 and 3,605,675 to Clemence, Jr., and 3,568,621 to Kawasaki all disclose systems in which the articulated ship is flexibly coupled.

It is apparent from the prior art, as exemplified above, that both rigidly coupled and flexibly coupled systems have advantages. In terms of acting as a unitary ship, the rigidly coupled system far surpasses that of the flexibly coupled system. On the other hand, in terms of maneuverability in heavy seas, it may be desirable that certain relative motions of the two vessels be allowed while others be prevented as much as possible. In such cases, the flexibly coupled system may be preferred. As noted above, while both types of systems are disclosed in the prior art, there are no known practical systems by which both types of coupling can be accomplished with the same apparatus. It should also be pointed out that in rigidly coupled systems heretofore disclosed, relative draft engagement of the coupled vessels has been limited to a plurality of discrete draft engagements rather than continuous relative draft engagement within the draft limits of the vessels.

SUMMARY OF THE INVENTION

It is, therefore, an object of the present invention to provide an apparatus for releasably coupling two movable bodies.

Another object of the present invention is to provide an apparatus for releasably coupling two floatable vessels.

Still another object of the present invention is to provide an articulated marine transportation combination having coupling means permitting both rigid and flexible coupling of the two vessels.

Yet another object of the present invention is to provide an articulated marine transportation combination having a coupling assembly permitting, within the respective draft limits of the vessels, continuous relative draft engagement thereof.

These and other objects of the present invention will become apparent from the drawings, the description given herein and the appended claims.

In one sense, the apparatus of the present invention comprises a first coupling assembly secured to one of two movable bodies, the first coupling assembly having a bearing membe providing opposed bearing surfaces. Secured to a second movable body is a second coupling assembly which has gripping means for frictionally engaging the bearing surfaces of the first coupling assembly, and means for effecting such engagement of the gripping means with the bearing surfaces.

In another embodiment, the present invention includes a first vessel having a notch at one end defined by oppositely disposed wings and a second vessel having a bow portion and sides. At least three of the first coupling assemblies described above are secured to the first vessel, one of which is disposed generally forward of the notch, the remaining two being disposed generally rearward of the notch and on respective ones of the opposed wings. Secured to the second vessel are three of the second coupling assemblies described above, the second coupling assemblies being disposed on the second vessel so as to be engagable with the first coupling assemblies when the second vessel is suitably received in the notch.

In still another embodiment, the present invention includes an articulated movable combination comprising a first body having a notch at one end defined by oppositely disposed wings, and a second body having a forward portion and sides. The first body has secured thereto at least one of the first coupling assemblies described above, the first coupling assembly being disposed generally forward of the notch. The second body has a second coupling assembly, described above, secured to the forward portion of the second body such that when the second body is received in the notch of the first body, the second and first coupling assemblies can be engaged to couple the respective bodies together. There are further included lateral thrust bearing means between the opposite sides of the second body and the wings, generally rearwardly of the notch. In the preferred form, the two bodies are floatable vessels, one of which, preferably the second vessel, is powered.

BRIEF DESCRIPTION OF THE DRAWINGS

FIG. 12 is a view similar to FIG. 6 showing a variation of the lateral bearing means.

FIG. 13 is a view taken along the lines 13—13 of FIG. 12.

FIG. 14 is an isometric view of a roller assembly employed in the lateral bearing means of FIG. 12.

DESCRIPTION OF THE PREFERRED EMBODIMENTS

In the description which follows, the invention will be described with particular reference to an articulated ship, i.e. a segmented ship comprised of two vessels, generally a cargo vessel and a powered vessel, e.g. a tug. As will be seen, the articulated ship can be one in which the respective vessels are (1) rigidly coupled together or (2) flexibly coupled together, the latter to the extent that a certain degree of relative movement between the vessels of the articulated ship is permitted. It is to be understood, however, that the coupling apparatus of the present invention finds application wherever two movable bodies are to be coupled together to form an articulated assemblage.

Figure 8:
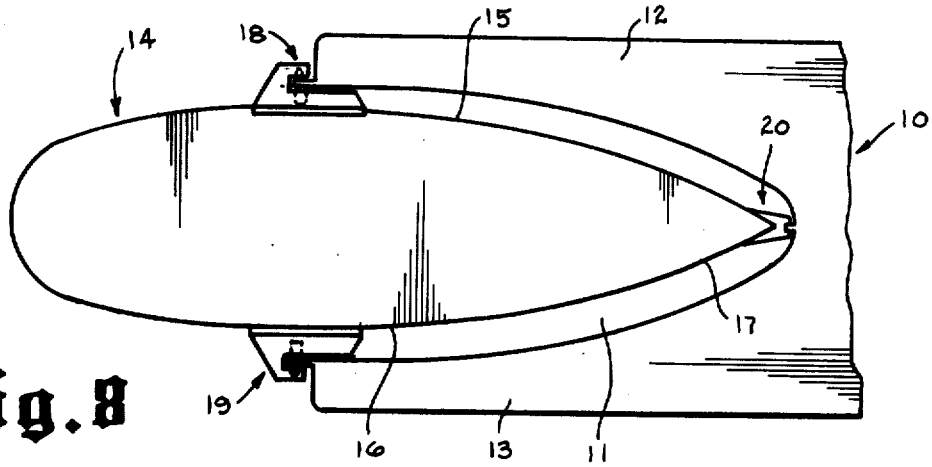
FIG. 8 is a fragmentary top plan view of another embodiment of the present invention showing a coupled tug and barge.

Referring first to FIG. 8, there is shown a first vessel or barge 10 having a throughgoing notch 11 defined by opposed port and starboard wings 12 and 13, rspectively, extending aft of barge 10. Partially received into notch 11 is a second vessel or tug 14 having opposed port and starboard sides 15 and 16, respectively, and a forward or bow portion 17. As seen from FIG. 8, the shape of the notch 11 is generally complementary to that of the portion of the tug 14 received therein. However, the shape of notch 11 need not conform to that of the portion of tug 14 received therein and need only be such as to accommodate coupling of the vessels employing the coupling means described herein.

In the mated position shown in FIG. 8, tug 14 is coupled to barge 10 by three independent coupling means, the three coupling means comprising forward or bow coupling means 20 and port and starboard coupling means 18 and 19, respectively. Coupling means 18, 19 and 20, which are described more fully below, all include a first coupling assembly secured to one of the vessels, in this case barge 10, and a second coupling assembly secured to the other of the vessels, in this case tug 14. While there is some difference in their mounting on the vessels, as will be seen, the basic construction and operation of the coupling means 18, 19 and 20 is substantially identical. Accordingly, the terms "first coupling assembly" and "second coupling assembly" are used with regard to all three coupling means.

Figure 2:
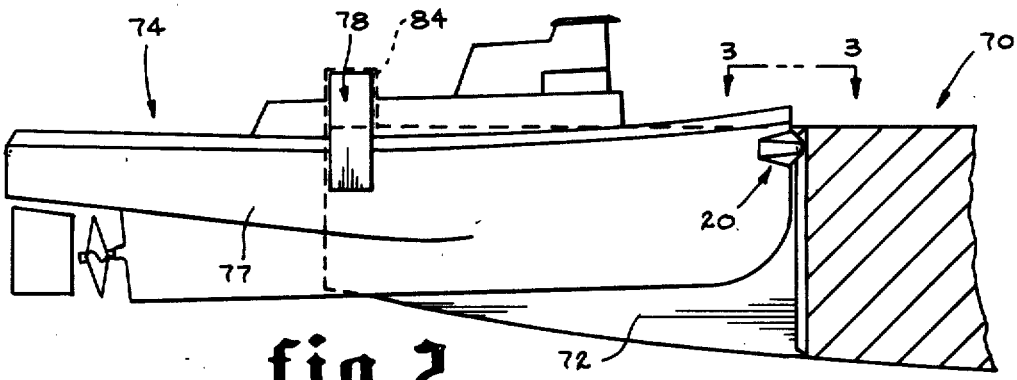
FIG. 2 is an elevational view, partly in section, taken along the lines 2—2 of FIG. 1.
Figure 3:
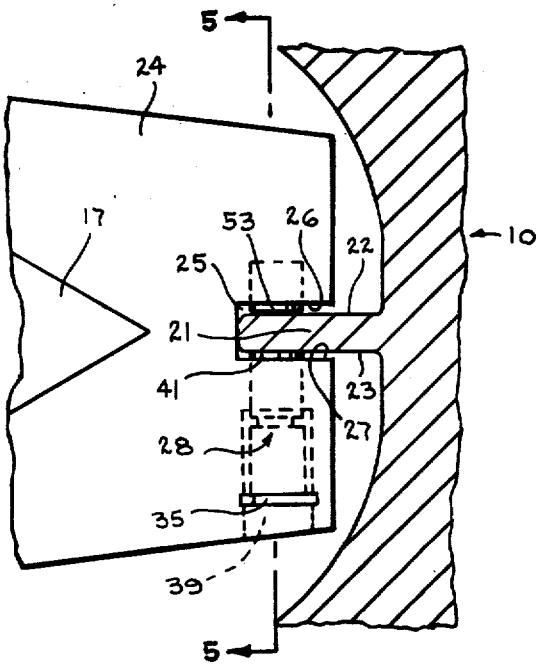
FIG. 3 is a view, enlarged, taken along the lines 3—3 of FIG. 2.
Figure 4:
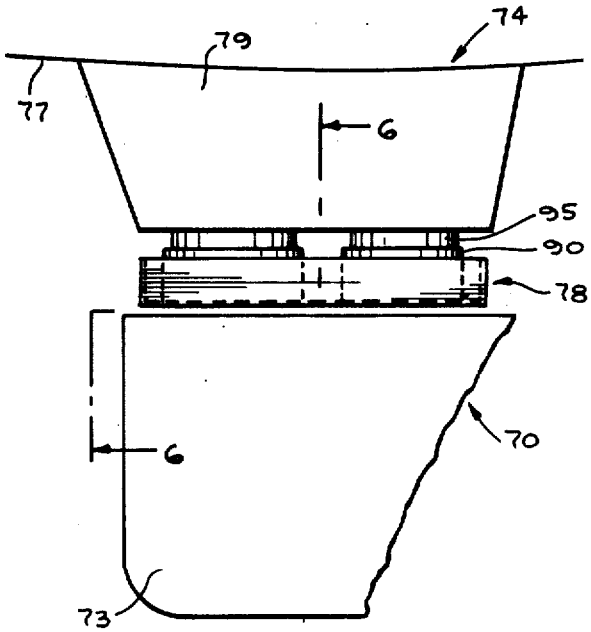
FIG. 4 is a fragmentary top olan view showing the adjustable lateral bearing means employed in one embodiment of the present invention.
Figure 7:
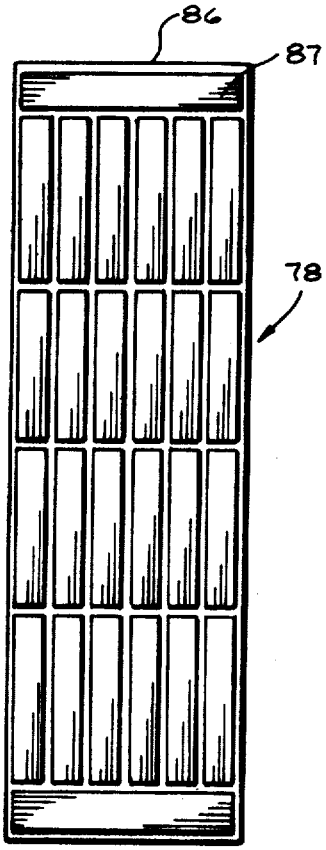
FIG. 7 is a view taken along the lines 7—7 of FIG. 6.

Turning now to FIG. 3, there is shown in greater detail bow coupling means 20. While FIG. 3 is actually a view of the embodiment of FIG. 2, the bow coupling means 20 used in the embodiments of FIGS. 7 and 8 is identical. As noted above, bow coupling means 20 comprises first and second coupling assemblies. The first coupling assembly comprises a generally vertically extending plate or bar 21 secured to barge 10 at substantially the apex of notch 11, plate 21 serving as a bearing member having opposed vertical and generally parallel bearing surfaces 22 and 23. Secured to the bow or forward portion 17 of tug 14 is a mounting member 24, mounting member 24 having a vertically extending slot 25 partially defined by lateral walls 26 and 27, the width of slot 25 being larger than the thickness of bearing member 21 between bearing surfaces 22 and 23. As can be seen from FIGS. 3 and 8, when tug 14 is matingly received in notch 11, bearing member 21 extends into slot 25 between the lateral walls 26 and 27.

Disposed within mounting member 24 is the second coupling assembly. The second coupling assembly comprises gripping members 53 and 41, portions of which extend out of lateral walls 26 and 27. As will be explained more fully hereafter, gripping member 41 is mounted for movement in a direction generally transverse to bearing surfaces 22 and 23, such movement being effected by a piston-cylinder arrangement shown generally at 28 and mounted internally of mounting member 24.

Figure 5:
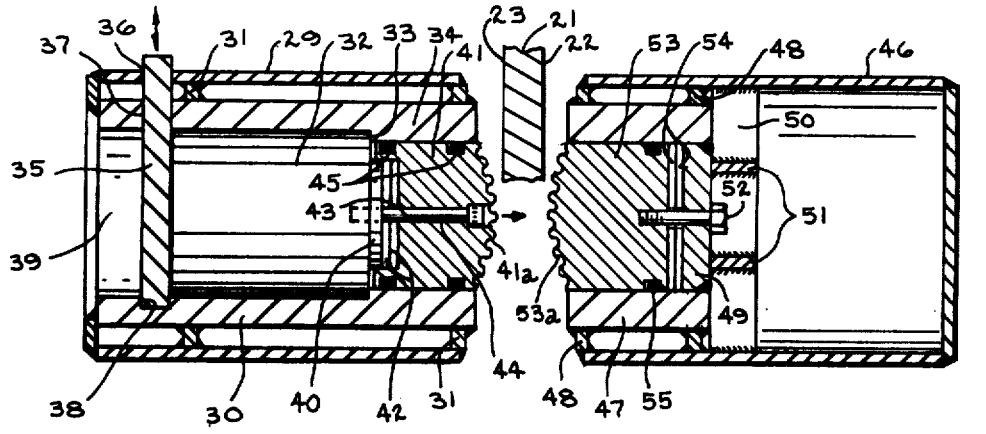
FIG. 5 is a detailed sectional view of a gripping means employed in the coupling means of the present invention.

The detailed construction and operation of the first and second coupling assemblies is best understood by reference to FIG. 5. Secured in the starboard side of mounting member 24 is housing 29. Mounted within housing 29 is a cylindrical guide tube 30, guide tube 30 and housing 29 being secured to one another by suitable webbing 31, webbing 31 being welded to housing 29 and guide tube 30. Disposed internally of guide tube 30 is hydraulic cylinder 32 and associated piston 40, cylinder 32 abutting a shoulder 33 formed by an internally upset portion 34 of guide tube 30. A removeable stop plate 35 extends through suitable openings 36 and 37 in the upper portions of housing 29 and 30 and, when fully inserted in a downward position, engages a groove 38 in guide tube 30. When stop plate 35 is securely in place, hydraulic cylinder 32 is secured against transverse, i.e. port or starboard, movement by shoulder 33 and stop plate 35. Removal of stop plate 35 permits access to hydraulic cylinder 32 through bore 39 which opens starboard of mounting member 24. Disposed in the cylindrical bore formed by internal upset portion 34 of guide tube 30 is cylindrical gripping member 41 having a gripping surface 41*a* formed by a plurality of concentric annular grooves. Gripping member 41 is spaced from piston 40 by self-lubricating thrust plates 42. A bolt 43 extending through a generally central bore 44 in gripping member 41 also extends through registering bores in thrust plates 42 and is threadedly received in piston 40. It will be observed that the threaded portion of bolt 43 at no time engages a complementary threaded portion of bore 44. Accordingly, gripping member 41 is free to rotate about the axis defined by bolt 43. O-ring 45 disposed in an annular groove on the outer periphery of gripping member 41 provides sealing between the internal upset portion 34 of guide tube 30 and gripping member 41.

Located on the port side of slot 25 in mounting member 24 is housing 46 internally of which is cylindrical guide tube 47, guide tube 47 being secured to housing 46 by webbing 48 welded to guide tube 47 and housing 46. A bearing plate 49 is disposed internally of and welded to guide tube 47 and a support framework consisting of webbing members 50 and 51, the support framework in turn being welded to housing 46. Bearing plate 49 is spced from cylindrical gripping member 53 by self-lubricating thrust plates 54. A bolt 52 extends through central bores in bearing plate 49 and thrust plates 54 and is threadedly received in cylindrical gripping member 53. O-ring 55 effects sealing between cylindrical gripping member 53 and the guide tube 47. As can be seen, gripping member 53 is free to rotate within guide tube 47 on the generally horizontal axis defined by bolt 52.

Like member 41, gripping member 53 has a gripping surface 53*a* formed by a plurality of concentric annular grooves.

It will be apparent that, whereas both gripping members 41 and 53 are permitted to rotate on the same general horizontal axis defined by bolts 52 and 44, gripping member 53 is restrained from any substantial transverse movement relative to bearing surface 22. Accordingly, when tug 14 is received in notch 11, and bearing member 21 is received in slot 25, bearing surfaces 23 and 22 will be in position to be engaged by gripping surfaces 41*a* and 53*a* respectively. Movement of piston 40 in a port direction, i.e. toward bearing surface 23, will force gripping surface 41*a* into engagement with bearing surface 23 which in turn will, if necessary, cause movement of bearing member 21 toward gripping member 53 until bearing surface 22 and gripping surface 53*a* are engaged. As a practical matter, the clearances between gripping surface 41*a* and bearing surface 23 and gripping surface 53*a* and bearing surface 22 and relatively small even when the vessels are not coupled. Accordingly, very little movement of bearing member 21 toward gripping surface 53*a* occurs upon movement of gripping member 41 toward bearing surface 23.

The grooved gripping surface 41*a* and 53*a* serve to enhance frictional engagement between the gripping members and bearing member 21. Other surface configurations such as dimpled, waffled, etc., may be employed to achieve the enhanced frictional engagement between the gripping members and the bearing surfaces, it being understood that the gripping surfaces can be smooth if desired.

The hydraulic piston-cylinder arrangement described above is of the double-acting type whereby gripping member 41 can also be moved in a direction away from bearing surface 23 resulting in disengagement of bearing member 21 and gripping members 41 and 53. It should further be observed that while a double-acting piston-cylinder arrangement is shown other means of effecting engagement of gripping members with bearing member 21 can be employed. Such means, which may be considered force modules, can include single-acting piston-cylinder systems using manual or mechanical return, mechanical systems such as cams, screws, etc., or electrical systems such as solinoids, electromagnets, etc.

Figure 11:
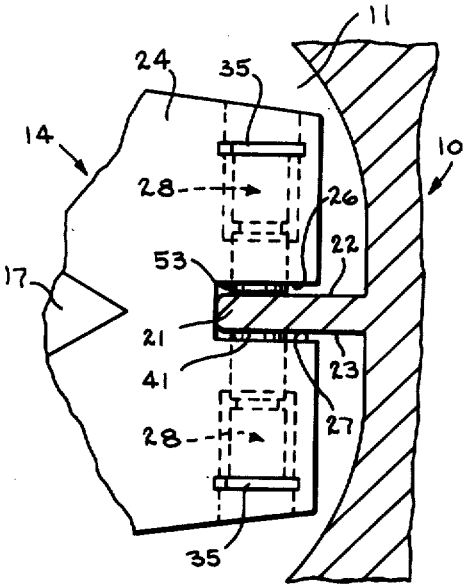
FIG. 11 is a view similar to FIG. 3 and showing a variation of the coupling means of the present invention.

While in the coupling means depicted in FIGS. 3 an 5, only one of the gripping members is mounted for transverse movement in a direction generally transverse to bearing member 21, it is apparent that both of the gripping members can be so mounted. Such as arrangement is shown in FIG. 11 where a dual piston-cylinder systems, such as depicted in FIGS. 3 and 5 are used in conjunction with both gripping members 53 and 41.

Figure 9:
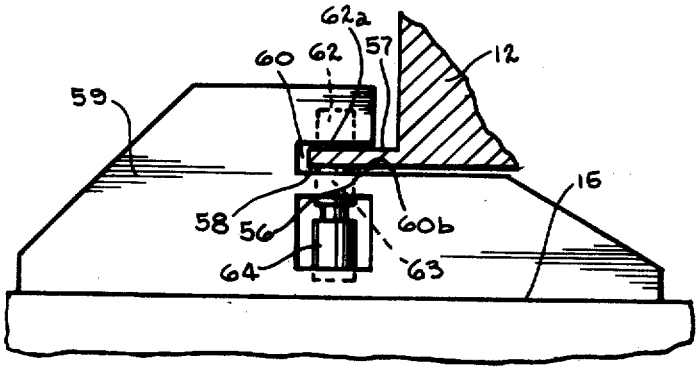
FIG. 9 is an enlarged view of the side coupling means employed in the embodiment of FIG. 8.

In FIG. 9 is shown the port coupling means 18, it being understood that starboard coupling means 19 is identical in construction. As noted above, coupling means 18 and 19 function the same as coupling means 20 and are, in pertinent part, substantially identical structurally, save for their mounting assemblies employed and their relative disposition on the vessels. Depending from the aft of port wing 12 is the first coupling assembly comprising vertically extending bearing member 56 having opposed vertical and generally parallel bearing surfaces 57 and 58. It will be appreciated that bearing member 56, like bearing member 22 generally extends for substantially the full height of notch 11. Secured to the port side 15 of tug 14 is port mounting member 59 having a forwardly opening, generally vertical slot 60 having opposed lateral wall 60*a* and 60*b*. Mounted in wall 60*a* of mounting member 59 is gripping member 62, gripping member 62 being mounted substantially the same as gripping member 53, i.e. rotatably around a generally horizontal axis but fixed against motion in a direction transverse to bearing surfaces 57 and 58. Disposed on the other side of slot 60 in wall 60*b* and facing bearing surface 58 is gripping member 63, gripping member 63 being mounted substantially the same as gripping member 41 and being operatively connected to piston-cylinder arrangement 64, basically the same as piston-cylinder cylinder system 28 shown in FIG. 5, to effect movement of gripping member 63 in a direction toward bearing surface 58 and assuming a double-acting piston-cylinder system is used to effect movement of gripping member 63 away from bearing surface 58. As in the case of the embodiment shown in FIG. 11, both gripping members 62 and 63 may be operatively connected to suitable force modules to effect engagement with bearing member 56.

Figure 10:
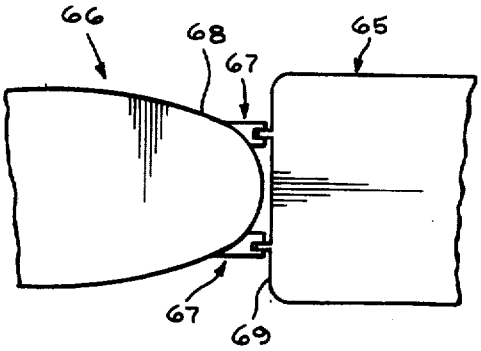
FIG. 10 is a fragmentary top plan view of another embodiment of the present invention.

In FIG. 10 is shown an embodiment of the present invention wherein a barge shown at 65 and a tug shown at 66 are coupled at the stern 69 of the barge 65 and the bow 68 of the tug 66, there being no notch on barge 64. Dual coupling means 67, substantially identical with coupling means 20, are used to couple tug 66 and barge 65 together. It will be observed that the second coupling assemblies described above and comprising the gripping members are connected to the forward portion 68 of tug 66, forward portion 68 having a more blunted nose to accommodate lateral spacing of the assemblies. Likewise, the stern 69 of barge 65 has secured thereto the first coupling assemblies described above and comprising the vertical bearing member, the first coupling assemblies beng suitably spaced so as to register with and be engagable with the first coupling assemblies upon mating of tug 66 and barge 65.

It is to be observed that in the preferred case, the generally cylindrically shaped gripping members of each of the second coupling assemblies will lie on a rotate about the same, generally horizontal, axis, although the axes need not all lie in the same horizontal plane. Thus, for example, the gripping members of forward or bow coupling means 20 could be disposed relatively higher or lower than those of coupling means 18 or 19 which, in turn, could also be in different horizontal planes. It is further to be noted that the disposition of the coupling means relative to the two vessels will depend upon such parameters as weight, length and other such dimensions of the vessels and, as can be seen below, on the type of coupling desired, i.e. whether of the rigid or flexible type.

The extreme vetsitility and utility of the invention described herein is clearly brought out by an analysis of the capabilities of the system. For example, it is to be observed that within the draft limits of the mated vessels, the coupling means provides continuous relative draft engagement. This is in contrast to other mainly rigidly coupled systems in which relative draft engagement of the two coupled vessels is limited to a plurality of discrete coupling points. For practical purposes, relative draft engagement is limited only by the vertical extent of the bearing members which can be co-extensive with the draft limits of the vessel. The unique coupling means provides for both rigid and flexible coupling of two bodies together. In regard to the former, it should be observed from FIG. 8 that when coupling means 18, 19 and 20 are all engaged and the gripping members have frictionally engaged the vertically extending bearing members, an articulated system which is rigidly connected is achieved. Moreover, this rigid interconnection is achieved in a manner which for practical purposes can be considered to be a three-point suspension system. In this regard, it is important to note that the area of engagement between the gripping members and the bearing surfaces, relative to the sizes of the two mated vessels is small such that, for practical purpose, point engagement at the coupling sites is achieved. This permits the vessels to engage and disengage extremely rapidly, a feature which cannot be over emphasized from a safety point of view. By utilizing a suitable control system operatively connected to all of the coupling means, i.e. coupling means 18, 19 and 20, the latter can be engaged or disengaged virtually simultaneously which will provide virtually instantaneous engagement or disengagement of the two vessels.

The coupling means described herein also provides a unique system for providing flexible coupling, i.e. allowing some relative movement between the coupled vessels. In the embodiment of FIG. 8, if the gripping members in coupling means 18 and 19 are not frictionally engaged with the corresponding bearing members, tug 14 will be allowed to pivot, in a generally vertical plane, around coupling means 20, it being remembered that the gripping members are rotatable relative to tug 14. Adjustment of the aft coupled means 18 and 19 so as to allow vertical sliding of the gripping members on the bearing surfaces will allow such vertical pivoting but will substantially curtail any relative rolling, yawing, i.e. steering, of the coupled vessels. The embodiment of FIG. 10 shows still another articulated ship wherein flexible coupling is achieved.

Thus, the coupling means of the present invention in one basic structure provides a means whereby two vessels may be rigidly or flexibly coupled. It should be borne in mind that while the invention has been described with regard to the second coupling means being secured to the powered or pushing vessel, they can, of course, be secured to the pushed vessel. Generally, however, since the power and control systems are usually on the pushing vessels, the movable, gripping members would be more conveniently secured to the powered or pushing vessel.

Another advantage of the coupling means resides in the fact that, because of its unique design and manner of coupling, auxilliary equipment to lash or otherwise secure the vessels together can be minimized and, in some cases, dispensed with. Once the bearing surfaces are frictionally engaged by the gripping members the two vessels are not simply coupled but are, for all intents and purposes, locked together. Nonetheless, it may be desirable, particularly in heavy sea conditions or as a safety measure, to employ securing devices such as hydraulic rams, winches, cables, turnbuckles, bolts or the like.

Figure 1:
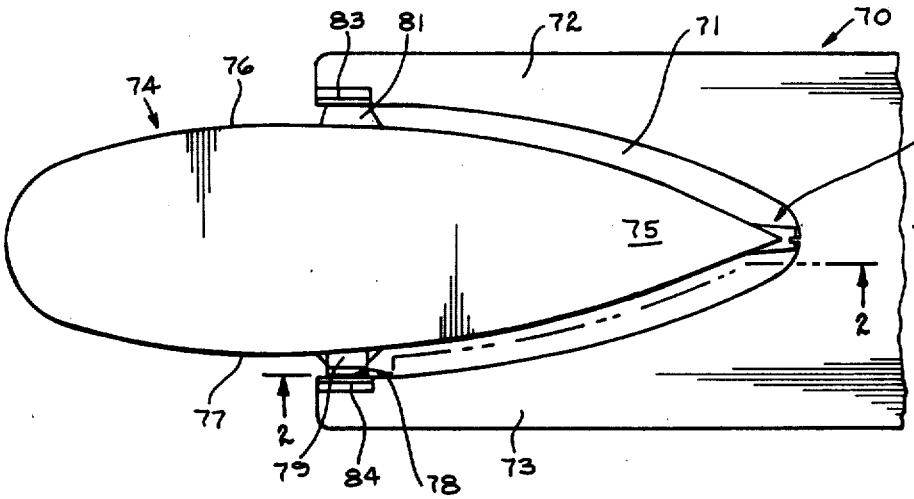
FIG. 1 is a fragmentary top plan view of one embodiment of the present invention showing a coupled tug and barge.

Attention is now directed to FIGs. 1, 2, 4, 6 and 7 for a description of a modified form of the articulated ship of the present invention. Referring first to FIG. 1, there is shown a barge or pushed vessel 70 having a throughgoing notch 71 at one end thereof defined by port and starboard wings 72 and 73, respectively. Received in notch 71 is a tug 74 having a forward portion 75 and port and starboard sides 76 and 77, respectively. Coupling means 20, identical to that shown in FIGS. 3, 5 and 8 couples the forward portion 75 of tug 74 to barge 70, coupling occurring substantially at the apex of notch 71 and the bow of tug 74. Disposed between the side 77 of tug 74 and the inner wall of starboard wing 73 is a lateral thrust bearing 78 whose construction and operation will be described more fully hereafter. Lateral thrust bearing 78 is extensible and retractable in a generally port and starboard direction and is secured to thrust bearing mounting member 79 which in turn is secured to the side 77 of vessel 74. A bearing or guide surface 80 (See FIG. 4) is formed on the inner wall of starboard wing 73 adjacent lateral thrust bearing 78.

Disposed between the port side 76 of rtug 74 and the inner wall of port wing 72 is a second lateral thrust bearing 81, lateral thrust bearing 81 likewise being engagable with a bearing or guide surface, which as in the case of bearing surface 80, can be partly formed by the inner wall of wing 72. Lateral thrust bearing 81, unlike thrust bearing 78, is fixed against generally port or starboard movement. Extending generally vertica4ly upwardly from wings 72 and 73 are above-deck guides 83 and 84, respectively, guides 83 and 84 forming vertical upward extensions of the bearing surfaces formed on the inner walls of wings 72 and 73, respectively. Guides 83 and 84, which extend the bearing surfaces against which thrust bearings 81 and 78, respectively, bear, allow for greater latitude in terms of relative draft engagement of the two vessels and maximum relative pitching or pivoting of the two vessels about coupling means 20 when the latter is engaged.

Figure 6:
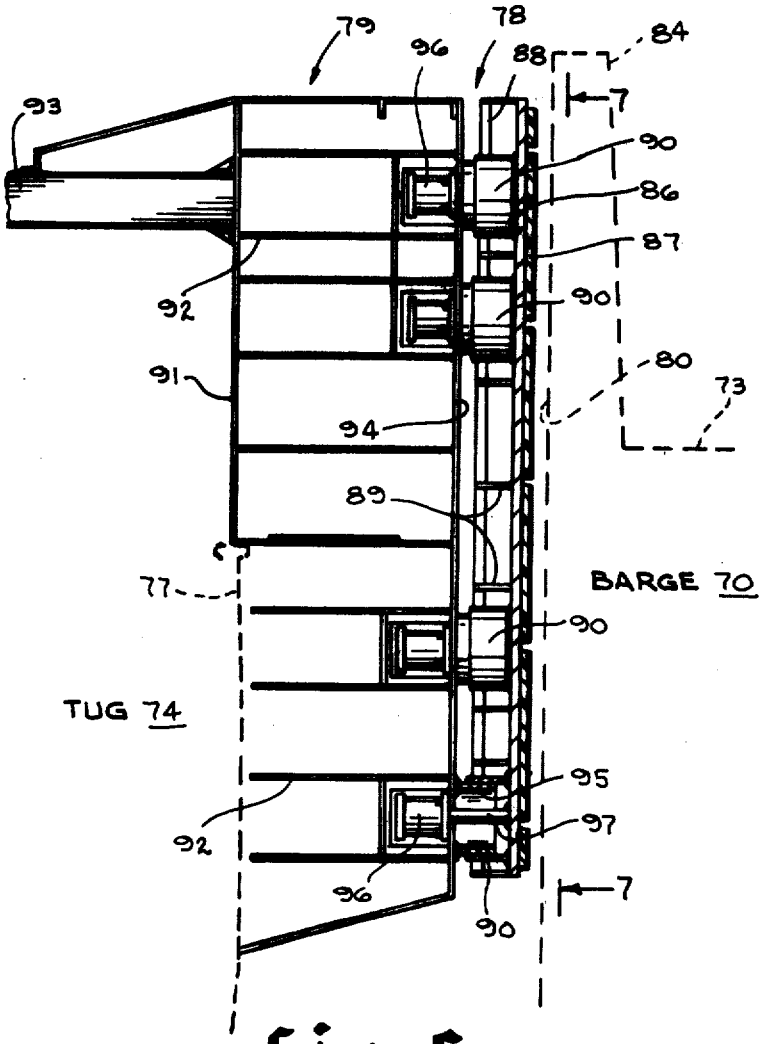
FIG. 6 is a detailed elevational view, partly in section, taken along the lines 6—6 of FIG. 4.

Reference is now made to FIGS. 6 and 7 for a detailed description of adjustable lateral thrust bearing 78. Lateral thrust bearing 78 includes a substantially flat plate 86 to which are secured a plurality of resilient pads 87. The term "resilient" as employed herein, is intended to mean a material possessing sufficient rigidity and resistence to compression so as to prevent any substantial deformation thereof, but yet possessing some degree of elasticity. In general, pads 87 will comprise certain polymeric materials, either in pure or composite form. Plate 86 is secured to a framework comprising vertical support beams 88 and generally horizontal ribs 89. Secured to the back side of plate 86 are a plurality of cylindrical guide tubes 90, the number and disposition being dependent upon the size of the thrust bearing which in turn depends upon the relative size of the vessels. In the embodiment shown, eight such tubes are employed. As best seen in FIG. 6, guide tubes 90 open in a direction facing the side 77 of tug 74.

Secured to the side of tug 74 is a thrust bearing mounting member 79, mounting member 79 comprising a framework of vertical beams 91 and cross-webbing 92. As can be seen from FIG. 6, mounting member 79 extends above the deck of tug 74 and is connected to a crossbeam 93, crossbeam 93 in turn being secured to the deck of tug 74 and, preferably, being connected to or being an extension of a like beam extending from fixed thrust bearing 81. It will be understood that the mounting member 79 can be constructed in many ways, the only requisite being that it be so designed and of a material as to possess the strength to withstand the forces encountered in the environment in which the articulated ship is to be used. Forming part of mounting member 79 is a face plate 94 having a series of cylindrical mounting member guide tubes 95 secured thereto, each tube 95 being disposed so as to be telescopically engagable with a corresponding thrust bearing guide tube 90. Disposed within mounting member 79 are a plurality of double-acting piston-cylinder systems comprising cylinders 96 and pistons 97, the piston-cylinder systems being of the conventional hydraulic type. Pistons 97 extend through openings in face plate 94 and are secured to plate 86 of thrust bearing 78. Each of the piston-cylinder assemblies is disposed within mounting member 79 such that each piston 97 lies generally concentric with the corresponding mounting member guide tube 95 and thrust bearing guide tube 90.

While not shown, fixed thrust bearing 81 will, to the extent of its bearing surface configuration, be substantially identical to the surface configuration of bearing 78 shown in FIG. 7. However, as noted, bearing 81 being fixed will be rigidly secured in a suitable fashion to the side 76 of tug 74.

The piston-cylinder systems can be easily controlled by well known means and methods so as to be simultaneously activated whereby either to extend thrust bearing 78 outwardly away from tug 74 and into engagement with bearing surface 80 or to retract bearing 78. It will be apparent that when tug 74 is received in the notch 71 of barge 70, and thrust bearing 78 is urged laterally outward in a starboard direction to engage bearing surface 80, tug 74 will be snugly fitted in notch 71, fixed lateral thrust bearing 81 engaging the bearing surface formed on wing 72 and adjustable lateral thrust bearing 78 engaging bearing surface 80. The snug engagement will allow tug 74 some freedom to pivot around coupling means 20 but will prevent any substantial relative yawing or rolling of tug 74 and barge 70.

While only one adjustable lateral thrust bearing 78 is shown, it will be apparent that adjustable thrust bearings may be provided on both sides of tug 74, i.e. a lateral thrust bearing similar to 78 may be substituted for fixed thrust bearing 81. As noted above, when the thrust bearings are engaged with the bearing surfaces on the wings of the barge and forward coupling means 20 is engaged, the two vessels are allowed relative vertical movement, i.e. pivoting about coupling means 20, such movement being retarded only by the frictional resistence between the lateral thrust bearings and the bearing surfaces on the wings of the barge. The relative vertical movement of pivoting about coupling means 20 can be essentially stopped depending on how much force is exerted on the lateral thrust bearings and, accordingly, the degree of frictional engagement between the thrust bearings and the bearing surfaces on the inner walls of the wing of the barge, i.e. the articulated ship can be made rigidly coupled.

Other than the above described double-acting piston-cylinder systems, other forms of force exerting devices such as cams, screws, etc., can be used in conjunction with the movable lateral thrust bearing to extend and retract the latter. It should also be noted that the thrust bearings, while shown as being secured to the powered vessel or tug, can be disposed on the wings of the barge, the former arrangement being preferred because of the usual presence of power and control systems on the powered vessel.

Reference is now made to FIGS. 12, 13 and 14 for a modified version of the lateral thrust bearing shown in FIGS. 6 and 7. In FIGS. 12 and 13, like characters are used to denote like elements of the lateral thrust bearing assembly shown in FIGS. 6 and 7. Mounting member 79 and lateral thrust bearing **78*a* shown in FIGS. 12 and 13 are identical in construction and operation with mounting member 79 and lateral thrust bearing 78 shown in FIGS. 6 and 7, except lateral thrust bearing 78*a* includes a plurality of roller assemblies, shown generally at 100**.

Roller housing 101 having upper and lower walls 102 and 103, respectively, side walls 104 and 105, respectively, and rear wall 106 is mounted in thrust bearing **78*a* by welds 111 which secure housing 101 to plate 86. While not shown, housing 101 is also supported by the frame work comprising vertical support beams 88 and horizontal ribs 89**.

Roller assembly 100, as best seen in FIG. 14, comprises a central, generally horizontally disposed shaft 107 fixedly secured, usually by welding, on each end to mounting brackets 108, opposite ends of shaft 107 extending through bores **108*a* in each bracket. Shaft 107 acts as a bearing surface for roller 109 which is preferably, though not necessarily, comprised of the same or similar material as pads 87, and which is free to rotate around shaft 107. Mounting brackets 108 abut the surface 106*a* of wall 106 and are tapped (not shown) to receive bolts 110 which extend through registering holes (not shown) on either side of the rear wall 106 of roller housing 101. As best seen in FIG. 14, the width of roller assembly 100, taken between the outside surfaces of opposed mounting brackets 108 is substantially equal to the width of housing 101 taken between the inside surfaces of side walls 104 and 105. Likewise, the height of roller assembly 100 taken between the top and bottom edges of brackets 108 is substantially equal to the distance between the inside surfaces of the walls 102 and 103. Accordingly, when roller assembly 100, comprising shaft 107, brackets 108 and roller 109, is inserted into roller housing 101, roller assembly 100 is substantially restrained from any vertical or horizontal movement. As can also be seen, preferably, roller assembly 100 is dimensioned such that when it is disposed within housing 101 and secured in the latter by means of bolts 110, roller 109 extends outwardly past the surface of pads 87 not more than the radial thickness of roller 109**.

While the roller assemblies 100 have been described with refernce to incorporation into the adjustable lateral thrust bearing **78*a*, it will be apparent that, in the preferred case, such roller assemblies will also be incorporated into the fixed lateral thrust bearing, such as 81**, as well. Likewise, when both lateral thrust bearings are adjustable, both may include the roller assemblies. The disposition and number of the rollers in the lateral thrust bearings will, of course, depend upon various parameters such as the size of the thrust bearings, the relative sizes of the vessels, etc.

Incorporation of the roller assemblies into the lateral thrust bearings greatly facilitates pivoting about coupling means 20. Since rollers 109 are free to rotate around shafts 107, the frictional forces between the lateral thrust bearings and the bearing surfaces on the wings of the barge are decreased. Not only does this permit easier relative pivoting of the two vessels around the coupling means 20, but it also lessens the chances that the resilient pads 87, if used, will be damaged. As noted, and as shown in FIG. 14, rollers 109 have a composition essentially the same as that of the pads 87. Thus, roller 109 is resilient, as that term is described above. Their resilient nature allows rollers 109 to be compressed or to yeild easier than if they are metallic in nature. In the event the forces exerted against rollers 109 are sufficient to compress or crush them beyond their yield point, the bearing surfaces on the wings of barge 70 will then engage pads 87. To this extent, the rollers provide a cushion which acts to protect the pads 87 against sudden damage. As is readily apparent, the roller assemblies are quite easily replaced with new assemblies, and it will be appreciated that replacement of the roller assemblies is much easier than replacement of resilient pads 87. It is to be understood that while the rollers have been described with reference to their being constructed from a resilient material, they can, of course, be metallic in nature or of some other non-resilient material.

I claim:

1. An articulated movable combination comprising:

a first marine vessel having a throughgoing notch at one end, said notch having a pair of oppositely disposed wings;

a second marine vessel having a forward portion and sides, at least a portion of said second vessel being receivable in said notch;

said first marine vessel comprising at least one first coupling assembly including at least one bearing member having oppositely directed, non-resilient, substantially vertical bearing surfaces, said second vessel comprising a second coupling assembly, said second coupling assembly being engageable with said first coupling assembly generally forward of said notch when said second vessel is received in said notch, said second coupling assembly including gripping means having rigid gripping surfaces for frictionally and non-resilienty engaging said bearing surfaces;

said gripping means comprising first and second gripping members, said first gripping member having a surface engageable with one of said bearing surfaces, said second gripping member having a surface engageable with the other of said bearing surfaces, said first gripping member being mounted for movement in a direction generally transverse to said bearing surfaces, said gripping members being generally cylindrical and mounted for rotation about a generally common horizontal axis, said axis being generally transverse to said bearing surfaces;

means for effecting engagement of said gripping means with said bearing surfaces; and lateral bearing means disposed between opposite sides of said second body and said wings generally rearwardly of said notch, said lateral bearing means preventing substantial relative yawning and rolling of said first and second vessels.

2. The combination of claim 1 wherein said second vessel comprises a powered vessel.

3. The combination of claim 2 wherein said second coupling assembly is disposed closely adjacent the bow of said second vessel.

4. The combination of claim 3 wherein said bearing member comprises a plate secured to and projecting from said first vessel.

5. The combination of claim 2 wherein said bearing member is disposed substantially at the apex of said notch.

6. The combination of claim 5 wherein said bearing member is gripped between said first and second gripping members.

7. The combination of claim 1 wherein said second coupling assembly further includes means for disengaging said gripping means from said bearing surfaces.

8. The combination of claim 7 wherein said means for effecting engagement and said means for disengaging said gripping means are the same and comprise a piston-cylinder system.

9. The combination of claim 1 wherein said means for effecting engagement includes first means for moving said first gripping member toward said one bearing surface.

10. The combination of claim 9 wherein said second gripping member is mounted for movement in a direction generally transverse to said bearing surfaces and said means for effecting engagement includes a second means for moving said second gripping member toward said other bearing surface.

11. The combination of claim 9 wherein said means for effecting engagement further includes means for moving said first gripping member in a direction away from said one bearing surface to thereby cause disengagement of said gripping members and said bearing surfaces.

12. The combination of claim 11 wherein said first means for moving said first gripping member in a direction toward said one bearing surface and said means for moving said first gripping member in a direction away from said one bearing surface are the same and comprise a piston-cylinder system.

13. The combination of claim 1 wherein the surfaces of said gripping members engagable with said bearing surfaces have a plurality of concentric annular grooves.

14. The combination of claim 1 wherein said lateral bearing means are mounted on opposite sides of said second vessel and are engageable with bearing surfaces on respective ones of said wings when said second vessel is received in said notch of said first vessel.

15. The combination of claim 1 wherein one of said lateral bearing means is extendible and retractable.

16. The combination of claim 15 including means operatively connected to said laterally extendible and retractable bearing means for extending and retracting said laterally extendible and retractable bearing means.

17. The combination of claim 16 wherein said surfaces of said lateral bearing means are comprised of a resilient material.

18. The combination of claim 17 wherein said bearing means include roller means mounted for rotation about a generally horizontal axis.

19. The combination of claim 18 wherein said roller means comprise a rigid shaft forming a bearing surface and a cylindrical roller comprised of a resilient material surrounding said shaft, said shaft and said roller being mounted in said bearing means such that said roller extends outwardly from said resilient surface of said bearing means.

20. The combination of claim 18 wherein there are a plurality of said roller means.

21. The combination of claim 1 wherein said lateral bearing means include roller means mounted for rotation about a generally horizontal axis.

22. The combination of claim 21 wherein said roller means comprise a resilient material.

23. The combination of claim 21 wherein there are a plurality of said roller means.

24. The combination of claim 1 wherein said lateral bearing means are mounted on opposite sides of said second vessel and there are bearing surfaces on respective ones of said wings in opposed relationship to said bearing means when said second vessel is received in said notch of said first vessel.

25. The combination of claim 24 wherein at least one of said lateral bearing means is extendable and retractable so as to selectively control the degree of engagement between said bearing means and said bearing surfaces.

26. The combination of claim 25 wherein both of said lateral bearings means are extendable and retractable.

27. The combination of claim 1 wherein said bearing member is gripped between said first and second gripping members.

28. The apparatus of claim 1 wherein said bearing member comprises a plate secured to and projecting from said first floatable vessel.

29. The combination of claim 28 wherein said bearing member is disposed substantially at the apex of said notch.

30. The combination of claim 1 wherein said bearing member is disposed substantially at the apex of said notch.

31. The combination of claim 30 wherein said bearing member is gripped between said first and second gripping members.

32. A releasably coupled movable articulated apparatus comprising:

a first coupling assembly secured to a first floatable vessel, said first coupling assembly including at least one bearing member having opposed, substantially vertical, non-resilient bearing surfaces; and a second coupling assembly secured to a second floatable vessel, said second coupling assembly including gripping means having rigid gripping surfaces for frictionally and non-resiliently engaging said bearing surfaces, said gripping means comprising first and second gripping members, said first gripping member having a surface engageable with one of said bearing surfaces, said second gripping member having a surface engageable with the other of said bearing surfaces, said bearing member being gripped between said first and second gripping members, said first gripping member being mounted for movement in a direction generally transverse to said bearing surfaces, said gripping members being mounted for rotation about a generally common horizontal axis, said axis being generally transverse to said bearing surrfaces; and means for effecting engagement of said gripping means with said bearing surfaces, said means for effecting engagement including first means for moving said first gripping member toward said one bearing surface.

33. The apparatus of claim 32 wherein said second gripping member is mounted for movement in a direction generally transverse to said bearing surfaces and said means for effecting engagement includes a second means for moving said second gripping member toward said other bearing surface.

34. The apparatus of claim 32 wherein said means for effecting engagement further includes means for moving said first gripping member in a direction away from said one bearing surface to thereby cause disengagement of said gripping member and said bearing surfaces.

35. The apparatus of claim 34 wherein said first means for moving said first gripping member in a direction toward said one bearing surface and said means for moving said first gripping member in a direction away from said one bearing surface are the same and comprise a piston-cylinder system.

36. The apparatus of claim 32 wherein said bearing member comprises a plate secured to and projecting from said first floatable vessel.

37. A releasably coupled movable articulated apparatus comprising:

a first coupling assembly secured to a first floatable vessel, said first coupling assembly including at least one bearing member having opposed, substantially vertical, non-resilient bearing surfaces; and a second coupling assembly secured to a second floatable vessel, said second coupling assembly including gripping means having rigid gripping surfaces for frictionally and non-resiliently engaging said bearing surfaces, said gripping means comprising first and second gripping members, said first gripping member having a surface engageable with one of said bearing surfaces, said second gripping member having a surface engageable with the other of said bearing surfaces, said bearing member being gripped between said first and second gripping members, said first gripping member being mounted for movement in a direction generally transverse to said bearing surfaces, said gripping members being mounted for rotation about a generally common horizontal axis, said axis being generally transverse to said bearing surfaces;

means for effecting engagement of said gripping means with said bearing surfaces, and means for disengaging said gripping means from said bearing surfaces.

38. The apparatus of claim 37 wherein said means for effecting engagement and said means for disengaging said gripping means are the same and comprise a piston-cylinder system.

39. The apparatus of claim 37 wherein said bearing member comprises a plate secured to and projecting from said first floatable vessel.

40. A releasably coupled movable articulated apparatus comprising:

a first coupling assembly secured to a first floatable vessel, said first coupling assembly including at least one bearing member having opposed, substantially vertical, non-resilient bearing surfaces; and a second coupling assembly secured to a second floatable vessel, said second coupling assembly including gripping means having rigid gripping surfaces for frictionally and non-resiliently engaging said bearing surfaces, said gripping means comprising first and second gripping members, said first gripping member having a surface engageable with one of said bearing surfaces, said second gripping member having a surface engageable with the other of said bearing surfaces, said bearing member being gripped between said first and second gripping members, said first gripping member being mounted for movement in a direction generally transverse to said bearing surfaces, said gripping members being mounted for rotation about a generally common horizontal axis, said axis being generally transverse to said bearing surfaces; and means for effecting engagement of said gripping means with said bearing surfaces.

41. The apparatus of claim 40 wherein one of said vessels is a powered vessel.

42. The apparatus of claim 40 wherein the surfaces of said gripping members engagable with said bearing surfaces have a plurality of concentric annular grooves.

43. The apparatus of claim 40 wherein said bearing member comprises a plate secured to and projecting from said first floatable vessel.

* * * * *